United States Patent [19]

DiAmico

[11] Patent Number: 4,838,589

[45] Date of Patent: Jun. 13, 1989

[54] APPARATUS TO LOCK STORM DOORS AND AVOID DRAFT

[76] Inventor: John L. DiAmico, 3109 Dalton Ct., Bensalem, Pa. 19020

[21] Appl. No.: 87,765

[22] Filed: Aug. 21, 1987

[51] Int. Cl.[4] ..... E05B 13/00

[52] U.S. Cl. ..... 292/258; 292/256; 292/63; 16/220

[58] Field of Search ..... 292/256, 258, 155, 149, 292/63, 67; 16/220, DIG. 6, DIG. 32, DIG. 37

[56] References Cited

U.S. PATENT DOCUMENTS

| | | | |
|---|---|---|---|
| 389,704 | 9/1888 | Holland | 292/149 |
| 890,062 | 6/1908 | Johnson | 292/256 |
| 1,531,947 | 3/1925 | Jamieson et al. | 292/63 |
| 3,980,328 | 9/1976 | Pearson | 292/256 |
| 4,078,835 | 3/1978 | Spencer | 292/258 |

*Primary Examiner*—Nicholas P. Godici
*Assistant Examiner*—Carmine Cuda
*Attorney, Agent, or Firm*—Ferrill and Logan

[57] ABSTRACT

The present invention discloses a locking device for all forms of storm and screen doors. The device attaches between the door and the doorjamb and is secured into locking position by tightening a nut against a locking member. The device secures the door against intruders and against draft passing between the door and the doorjamb.

14 Claims, 1 Drawing Sheet

FIG. 1
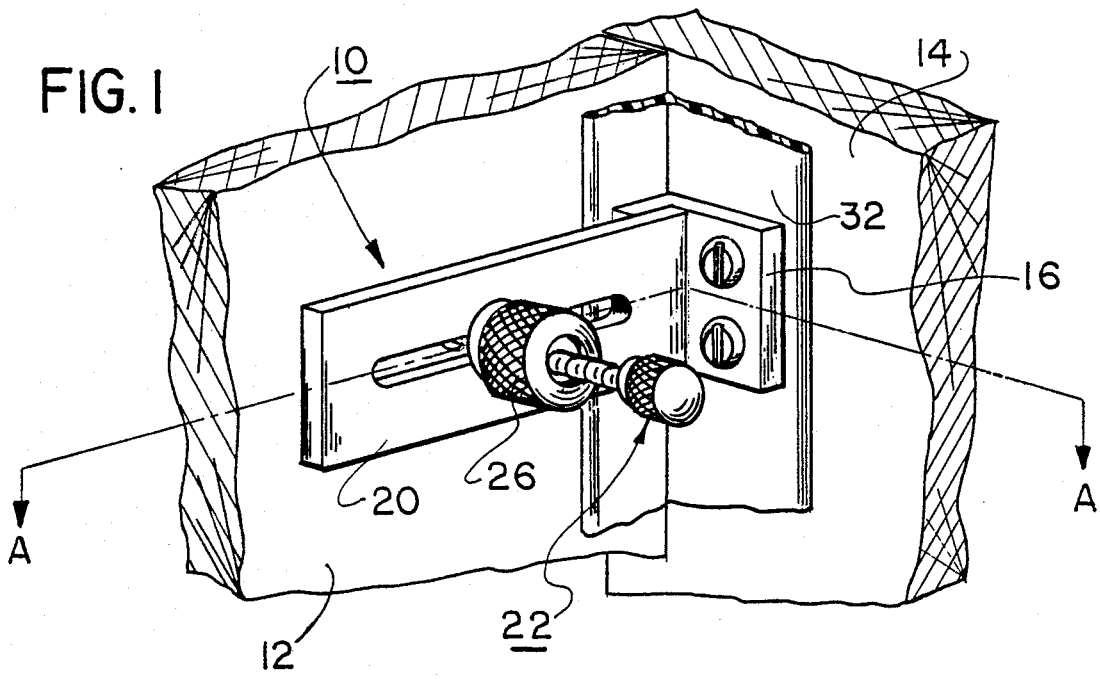
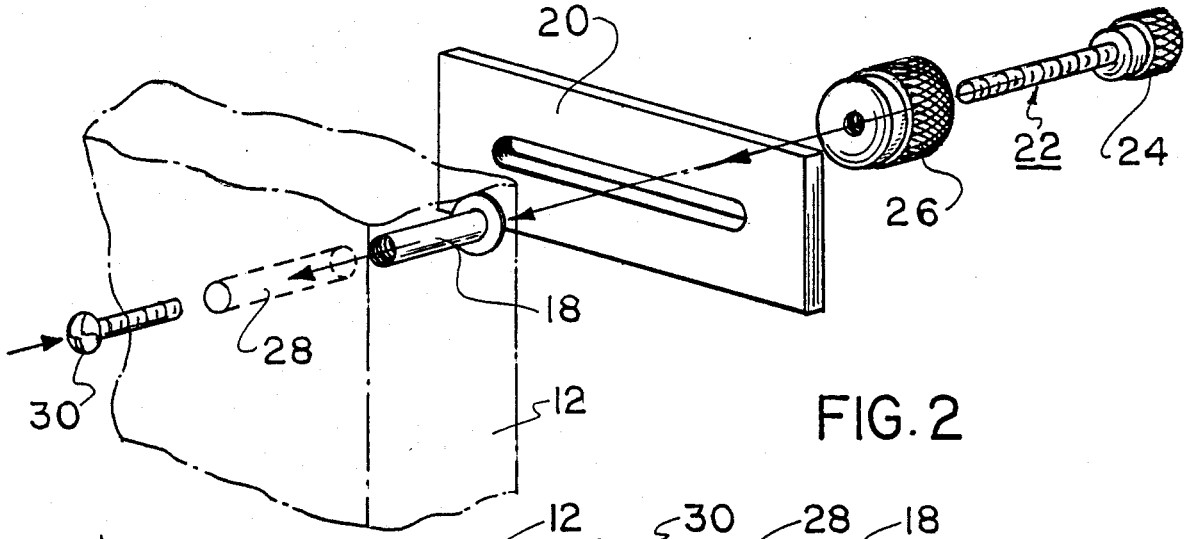
FIG. 2
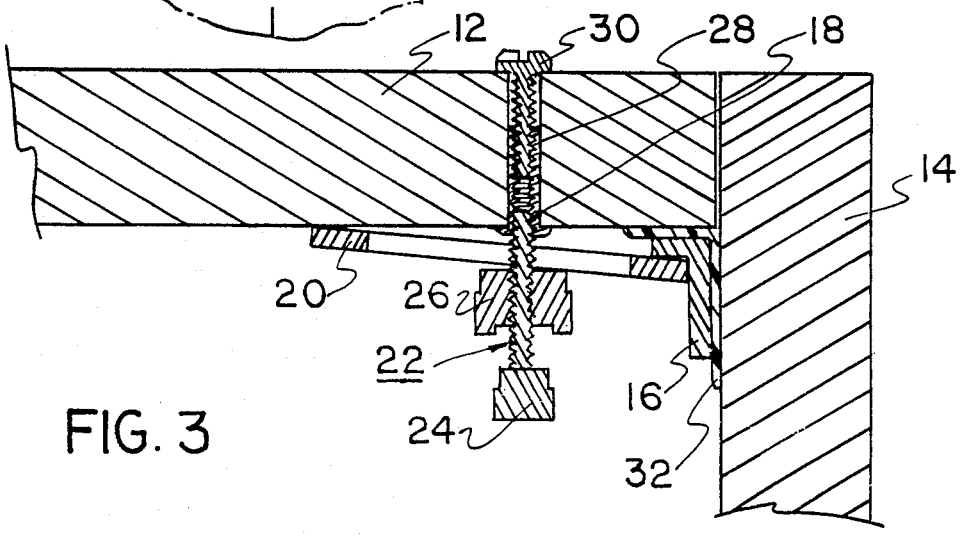
FIG. 3

APPARATUS TO LOCK STORM DOORS AND AVOID DRAFT

BACKGROUND OF THE INVENTION

1. Field of the Invention

The present invention relates to security devices for home use and, particularly, locking devices to secure storm and screen doors.

2. Description of Related Art

Presently there exist limited forms of locking devices for storm and screen doors. The most commonly used device is the conventional combined door handle and push-button latch. Although these devices work adequately well, they are not as secure as is desirable and they are generally ineffective in tightly securing the door to prevent draft.

Other forms of conventional door locking devices, such as a draw bolt, may be adapted for use on storm doors; however, such devices are not designed to be securely anchored to such doors and, again, are ineffective in preventing drafts.

Accordingly, it is a primary object of the present invention to provide an effective lock for use on storm and screen doors which is both secure and serves to tightly seal the door to prevent draft.

It is a further object of the present invention to provide such a lock which is easy to use and of relatively simple and inexpensive construction.

SUMMARY OF THE INVENTION

The present invention provides a locking device for all forms of storm and screen doors. The device attaches between the door and the doorjamb and secures the door from intruders and draft.

The lock of the present invention comprises: an L-shaped retention means which attaches to the doorjamb; a threaded sleeve which attaches to the storm door; a bar which passes between the retention means and the threaded sleeve; and a finger-actuated bolt means which threads into the sleeve and tightly retains the bar in locking position against the retention means.

The present invention provides a simple yet effective lock to prevent intrusion. Moreover, the screw-down locking mechanism of the present invention acts to pull the door tightly against the doorjamb so to prevent draft and improve the insulating efficiency of the door.

DESCRIPTION OF THE DRAWINGS

FIG. 1 is an elevational view of the present invention attached to and securing a storm door to a doorjamb.

FIG. 2 is an exploded view of the present invention.

FIG. 3 is a sectional view along line A—A of FIG. 1.

DETAILED DESCRIPTION OF THE INVENTION

The present invention provides a lock for storm and screen doors which is particularly secure from intruders and provides a tight seal to prevent drafts.

As is shown in FIG. 1, the lock 10 of the present invention attaches between the storm door 12 and a doorjamb 14. As is shown in FIGS. 2 and 3, the preferred embodiment of the lock 10 comprises: an L-shaped support stop 16 attached to the doorjamb 14; an internally threaded sleeve 18 attached to the storm door 12; a slotted rectangular bar 20 adapted to be positioned between the support stop 16 and the sleeve 18; attachment bolt 22, containing a finger-actuated head 24, adapted to pass through the slot in the bar 20 and attach to the threaded sleeve 18, retaining the bar 20 attached to the door 12; and a finger-actuated nut 26, such as a knurled nut or a wing nut, which is threaded into a position intermediate the ends of the attachment bolt 22 between the slotted bar 20 and the finger-actuated head 24.

The internally threaded sleeve 18 may be attached to the door 12 in one of two manners. As is shown in FIGS. 2 and 3, the sleeve 18 may be inserted into the inside of the door through a hole 28 drilled through the door 12. The sleeve 18 is anchored to the door 12 by passing a bolt 30 through the outside of the door and threading it within the sleeve 18. The bolt 30 must be short enough to leave sufficient space within the sleeve 18 to permit retention of the attachment bolt 22. Security is improved if the bolt 30 contains either a one-way screw head, as shown in FIG. 1, or an unslotted head (not shown), to prevent the lock 10 from being loosened from the outside of the door 12. Where an unslotted head bolt 30 is employed, tightening means on the sleeve 18, such as a slot or an inside face adapted for use with a wrench, may be necessary.

Alternatively, as is commonly employed with threaded sleeves used to provide anchorage of bolts retaining windows and screens to storm doors, the sleeve 18 may be crimped within the door 12. This adequately retains the sleeve 18 to the door 12 without compromising the exterior surface of the door 12. Due to the nature of this method of attachment, and the equipment necessary to accomplish it, use of this method may be limited to situations where the lock 10 is provided as original equipment on the door 12 or as an anticipated accessory.

As is shown in FIG. 1, in operation the bar 20 is positioned over the support stop 16 and the finger-actuated nut 26 is screwed down tight over the bar 20. This holds the bar 20 securely against the support stop 16 and prevents the door 12 from being opened except by loosening the nut 26 and moving the bar 20. A further benefit achieved in the locked position is that the screw-down locking mechanism of the present invention pulls the door 12 snugly against the doorjamb 14 and prevents drafts passing between the door 12 and the doorjamb 14. The placement of two locks 10 on the door, one near the top and one near the bottom, provides a particularly draft-free seal.

A more simplified embodiment of the present invention dispenses with the finger-actuated nut 26 and employs a somewhat truncated attachment bolt 22. The attachment bolt 22 is then fully threaded into the sleeve 18 so that its head 24 retains the bar 20 in locking position.

With certain storm door 12 installations which contain a wind barrier 32 attached to the doorjamb 14, the support stop 16 may not be necessary. Although not preferred, where a wind barrier 32 is available, the bar 20 may be tightened flush with the wind barrier 32 to retain the door 12 against the doorjamb 14.

While particular embodiments of the present invention have been disclosed herein, it is not intended to limit the invention to such a disclosure, and changes and modifications may be incorporated and embodied within the scope of the following claims.

What is claimed is:

1. A locking apparatus for a storm door, which door has an inside and an outside and which closes against a doorjamb, said apparatus comprising attachment means affixed to the inside of said door;

retention means attached to said doorjamb;

a locking member; and means to tighten said locking member toward said attachment means and retain the locking member against the retention means so as to prevent the storm door from being opened from the outside;

wherein said attachment means comprises an internally threaded sleeve, and said sleeve extends at least partially through the door, is threaded at both ends, and is held in place by a bolt passing through the outside of the door and threading into a portion of the sleeve within the door.

2. Apparatus in accordance with claim 1 wherein the bolt is a one-way bolt which can only be threaded inwardly.

3. Apparatus in accordance with claim 1 wherein the retention means is a support stop anchored to the doorjamb.

4. Apparatus in accordance with claim 1 wherein the storm door is provided with a conventional wind barrier attached to and projecting from the doorjamb, said retention means comprising the wind barrier.

5. Apparatus in accordance with claim 1 wherein said locking member is a bar containing an opening.

6. Apparatus in accordance with claim 5 wherein said opening is a slot.

7. A locking apparatus for a storm door, which door has an inside and an outside and which closes against a doorjamb, said apparatus comprising attachment means affixed to the inside of said door;

retention means attached to said door jamb;

a locking member; and means to tighten said locking member toward said attachment means and retain the locking member against the retention means so to prevent the storm door from being opened from the outside;

wherein said attachment means comprises an internally threaded sleeve, the locking member comprises a bar containing an opening, and the means to tighten the locking member toward the attachment means and retain the locking member against the retention means comprises a finger-actuated bolt means passing through the opening and threading into the sleeve; and wherein said finger-actuated bolt means comprises an attachment bolt which passes through the opening and threads into the sleeve, and a finger-actuated nut which travels along the attachment bolt and tightens against the locking member and retains the locking member against the retention means.

8. Apparatus in accordance with claim 7 wherein said finger-actuated nut comprises a nut with a knurled exterior.

9. Apparatus in accordance with claim 7 wherein the retention means is a support stop anchored to the doorjamb.

10. Apparatus in accordance with claim 7 wherein the storm door is provided with a conventional wind barrier attached to and projecting from the doorjamb, said retention means comprising the wind barrier.

11. Apparatus in accordance with claim 7 wherein said opening is a slot.

12. Apparatus in accordance with claim 7 wherein said sleeve extends at least partially through the door and is held in place by crimping a portion of the sleeve within the door.

13. Apparatus in accordance with claim 7 wherein said sleeve extends at least partially through the door, is threaded at both ends, and is held in place by a bolt passing through the outside of the door and threading into a portion of the sleeve within the door.

14. Apparatus in accordance with claim 13 wherein the bolt is a one-way bolt which can only be threaded inwardly.

* * * * *